US008282518B2

(12) United States Patent
Silverglate et al.

(10) Patent No.: US 8,282,518 B2
(45) Date of Patent: Oct. 9, 2012

(54) APPARATUS WITH MESH AND MANDUCABLE PROTRUSION

(75) Inventors: David E. Silverglate, Santa Cruz, CA (US); Brian Gulassa, Berkeley, CA (US)

(73) Assignee: GOT I, LLC, Atlanta, GA (US)

( * ) Notice: Subject to any disclaimer, the term of this patent is extended or adjusted under 35 U.S.C. 154(b) by 320 days.

(21) Appl. No.: 12/615,156

(22) Filed: Nov. 9, 2009

(65) Prior Publication Data

US 2010/0056310 A1 Mar. 4, 2010

Related U.S. Application Data

(63) Continuation-in-part of application No. 12/347,323, filed on Dec. 31, 2008, now Pat. No. 8,052,552.

(60) Provisional application No. 61/018,472, filed on Jan. 1, 2008.

(51) Int. Cl.
*A63B 43/00* (2006.01)
*A61J 9/08* (2006.01)

(52) U.S. Cl. ..... 473/612; 473/596; 215/11.6; 606/236

(58) Field of Classification Search ..... 473/575, 473/576, 596, 613, 614, 612; 606/234–236; 119/707; 215/11.6; D24/199
See application file for complete search history.

(56) References Cited

U.S. PATENT DOCUMENTS 1,319,297 A * 10/1919 Limacher ..... 215/11.1
1,626,425 A * 4/1927 Pelsue ..... 215/11.6
2,270,553 A * 1/1942 Potito ..... 473/596
3,046,016 A 7/1962 Laws
3,483,907 A * 12/1969 Corridon ..... 383/76
3,691,704 A 9/1972 Novak
3,889,950 A * 6/1975 Kasravi ..... 473/612
3,913,879 A * 10/1975 Wright, Jr. ..... 248/318
3,959,937 A 6/1976 Spunt
4,088,319 A * 5/1978 Clarke ..... 473/575
4,282,679 A * 8/1981 Grubb et al. ..... 446/419
4,309,852 A 1/1982 Stolpin
4,514,995 A * 5/1985 Curtis et al. ..... 66/170
4,637,941 A 1/1987 Rochte
4,813,674 A 3/1989 Lorhpipat
4,836,787 A 6/1989 Boo (Continued)

FOREIGN PATENT DOCUMENTS

EP 1870351 A1 * 12/2007

OTHER PUBLICATIONS

Binxy (Paci-Sphere) Product Description Document, 2 pages, Sep. 13, 2009.

(Continued)

*Primary Examiner* — Steven Wong
(74) *Attorney, Agent, or Firm* — Alleman Hall McCoy Russell & Tuttle LLP

(57) ABSTRACT

An apparatus is provided, which includes a plurality of elongated strands having joinder regions uniting adjacent strands at a distance along a length of an outer perimeter of the elongated strands, the elongate strands being configured to couple together for a distance along their lengths. The elongated strands form a surface of a mesh when the joinder regions are coupled. The apparatus may further include a manducable protrusion coupled to the mesh and extending a distance away from an exterior surface of the mesh.

12 Claims, 4 Drawing Sheets

U.S. PATENT DOCUMENTS

| | | | | | |
|---|---|---|---|---|---|
| 5,104,125 | A | | 4/1992 | Wilson | |
| 5,224,959 | A | | 7/1993 | Kasper | |
| 5,236,196 | A | * | 8/1993 | Blankenburg et al. | 446/87 |
| D340,991 | S | * | 11/1993 | Clements | D24/199 |
| D352,753 | S | * | 11/1994 | Giannini et al. | D21/678 |
| 5,364,348 | A | * | 11/1994 | Berry, Sr. | 604/77 |
| 5,411,262 | A | | 5/1995 | Smith | |
| D359,327 | S | * | 6/1995 | Gould | D21/713 |
| D453,571 | S | * | 2/2002 | Hall | D24/199 |
| 6,418,673 | B1 | | 7/2002 | Flowerday | |
| 6,524,272 | B1 | * | 2/2003 | Berry, Sr. | 604/77 |
| D477,441 | S | * | 7/2003 | Willinger et al. | D30/160 |
| 6,729,984 | B2 | * | 5/2004 | Silverglate | 473/612 |
| D514,263 | S | * | 1/2006 | Willinger | D30/160 |
| 7,152,750 | B2 | * | 12/2006 | Coffey | 215/11.6 |
| D563,609 | S | * | 3/2008 | Gick | D30/160 |
| D621,259 | S | * | 8/2010 | Joy et al. | D9/444 |
| 7,867,115 | B2 | * | 1/2011 | Zawitz | 473/570 |
| 7,901,375 | B2 | * | 3/2011 | Dunn et al. | 604/77 |
| D635,685 | S | * | 4/2011 | Hendricks et al. | D24/199 |
| D636,949 | S | * | 4/2011 | Axelrod et al. | D30/160 |
| D646,792 | S | * | 10/2011 | Pope | D24/194 |
| 2009/0057257 | A1 | * | 3/2009 | Marcus et al. | 215/11.6 |
| 2009/0170643 | A1 | | 7/2009 | Silverglate | |
| 2009/0170646 | A1 | | 7/2009 | Silvergate | |
| 2010/0179593 | A1 | * | 7/2010 | Lamar | 606/236 |

OTHER PUBLICATIONS

Binxy (Paci-Sphere) Product Pamphlet, 4 pages, Sep. 13, 2009.
Mother's Cubbard Name Tag, 2 pages, Sep. 13, 2009.
Mother's Cubbard Booth Listing, 2 pages, Sep. 13, 2009.
ISA Korean Intellectual Property Office, International Search Report of PCT/US2010/055855, Jul. 27, 2011, 9 pages.

* cited by examiner

APPARATUS WITH MESH AND MANDUCABLE PROTRUSION

CROSS REFERENCE TO RELATED APPLICATION

This application is a continuation-in-part of and claims priority to U.S. application Ser. No. 12/347,323, entitled "TOY APPARATUS WITH RATTLE" which in turn claims priority to U.S. Provisional Application 61/018,472, entitled "TOY APPARATUS INCLUDING A MESH", filed on Jan. 1, 2008. The entire disclosures of each of these applications are hereby incorporated by reference.

BACKGROUND

Balls are one of the oldest forms of toys and sports equipment, and many popular games today still involve rolling, passing, kicking, tossing, catching, bouncing, or hitting balls. Other toys may have similar play patterns as balls, and both balls and other toys may have smooth surfaces. Children and young adults and are also drawn to toys that can be accessorized with characters or other accessories that give the ball visual, acoustic and tactile interest. However, conventional balls and other toys having a smooth surface are not always suitable for attaching accessories, and can be difficult to grasp for some users, especially small children and infants.

SUMMARY

A toy apparatus having a surface is provided. The toy apparatus may include a mesh including a plurality of loop structures having cooperative mating surfaces disposed at least partially around an outer perimeter of each loop structure. The plurality of loop structures may have curved inside perimeter surfaces, and the cooperative mating surfaces of adjacent loop structures may be configured to couple together for a distance along their lengths. The loop structures form the surface of the toy when the cooperative mating surfaces are coupled with each other. The toy apparatus may further include a rattle positioned in a loop structure in the mesh, the rattle having a body with a mounting structure having an outer perimeter sized to conform to the curved inside perimeter surface of the loop structure in which the rattle is mounted. In some aspects, the mesh of the toy apparatus may be formed in the shape of a ball or other object that encloses a void. In other aspects, the mesh of the toy apparatus may not enclose a void.

According to another aspect, an apparatus is provided, which includes a plurality of elongated strands having joinder regions uniting adjacent strands at a distance along a length of an outer perimeter of the elongated strands, the elongate strands being configured to couple together for a distance along their lengths. The elongated strands form a surface of a mesh when the joinder regions are coupled. The apparatus may further include a manducable protrusion coupled to the mesh and extending a distance away from an exterior surface of the mesh.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The toy apparatus of the present disclosure may include a mesh of the form described in U.S. Pat. No. 6,729,984, entitled TOY BALL APPARATUS, which issued May 4, 2004, the entire disclosure of which is hereby incorporated by reference.

Figure 1:
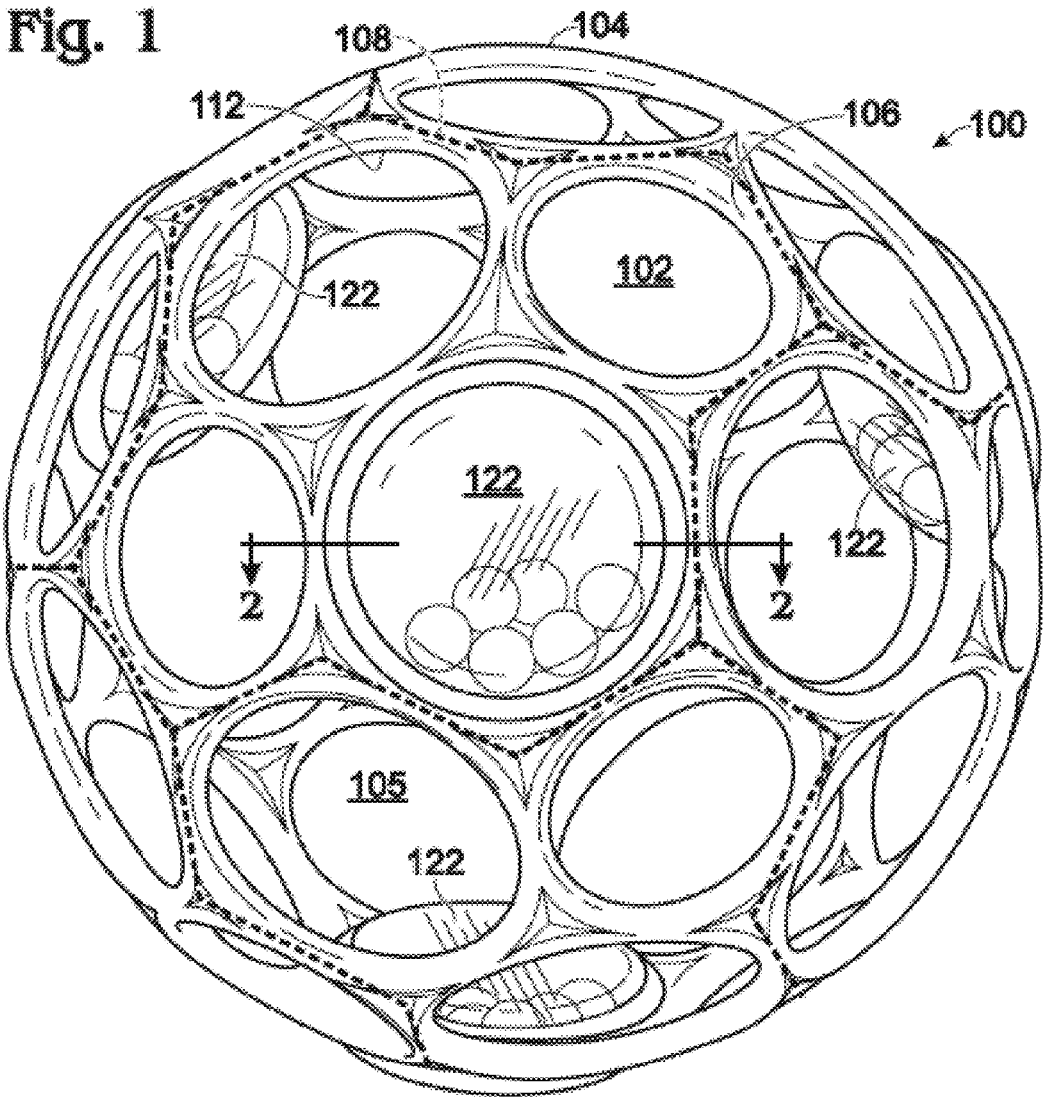
FIG. 1 is a front perspective view of a first embodiment of a toy apparatus formed from a resiliently deformable mesh of loop structures to be in the shape of a ball, and including a plurality of rattles inserted in respective loop structures of the mesh.
Figure 2:
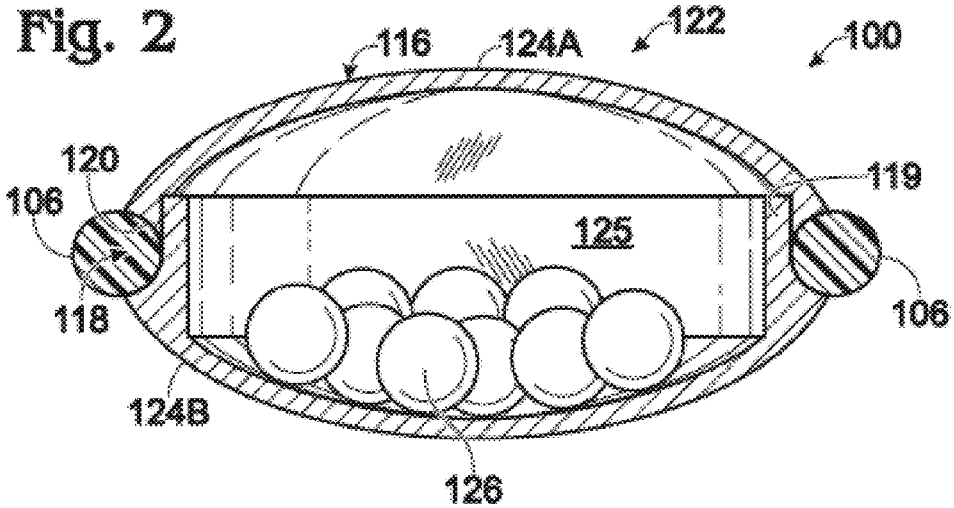
FIG. 2 is a cross-sectional view of one of the rattles of FIG. 1.

As illustrated in FIG. 1, a toy apparatus 100 is provided that has a surface 102 defined by a mesh 104. The mesh 104 typically includes a plurality of loop structures 106 having cooperative mating surfaces 108 disposed at least partially around an outer perimeter of each loop structure 106. The plurality of loop structures 106 have curved inside perimeter surfaces 112. As shown in FIG. 2, the curved inside perimeter surfaces 112 include a convex cross section. The cooperative mating surfaces 108 of adjacent loop structures 106 are configured to couple together for a distance along their lengths. The loop structures 106 form the surface 102 of the toy when the cooperative mating surfaces are coupled with each other. It will be appreciated that such a mesh 104 of loop structures 106 with curved inner perimeter surfaces 112 may be easily be grasped, even by the reflex action of an infant's grasping hands.

As shown in FIG. 2, the toy apparatus 100 may also include one or more rattles 122 positioned in a loop structure 106 in the mesh 104, each rattle 122 having a body 116 with a mounting structure 118 having an outer perimeter 120 sized to conform to the curved inside perimeter surface 112 of the loop structure 106 in which the rattle 122 is mounted. In the embodiment illustrated in FIG. 1, the mesh 104 is formed in the shape of a ball enclosing a void 105, and the plurality of rattles 122 are positioned at symmetric locations in the mesh 104. Although various numbers of rattles 122 may be provided, in the depicted embodiment of FIG. 1, four rattles 122 are provided. It will be appreciated that symmetric mounting of the rattles 122 around the spherical surface of the ball shaped mesh 104, ensures that the center of gravity of the ball with the rattles 122 mounted is near the geometric center of the ball, which in turn facilitates, smooth, predictable movement of the ball when rolled or thrown.

Figure 3:
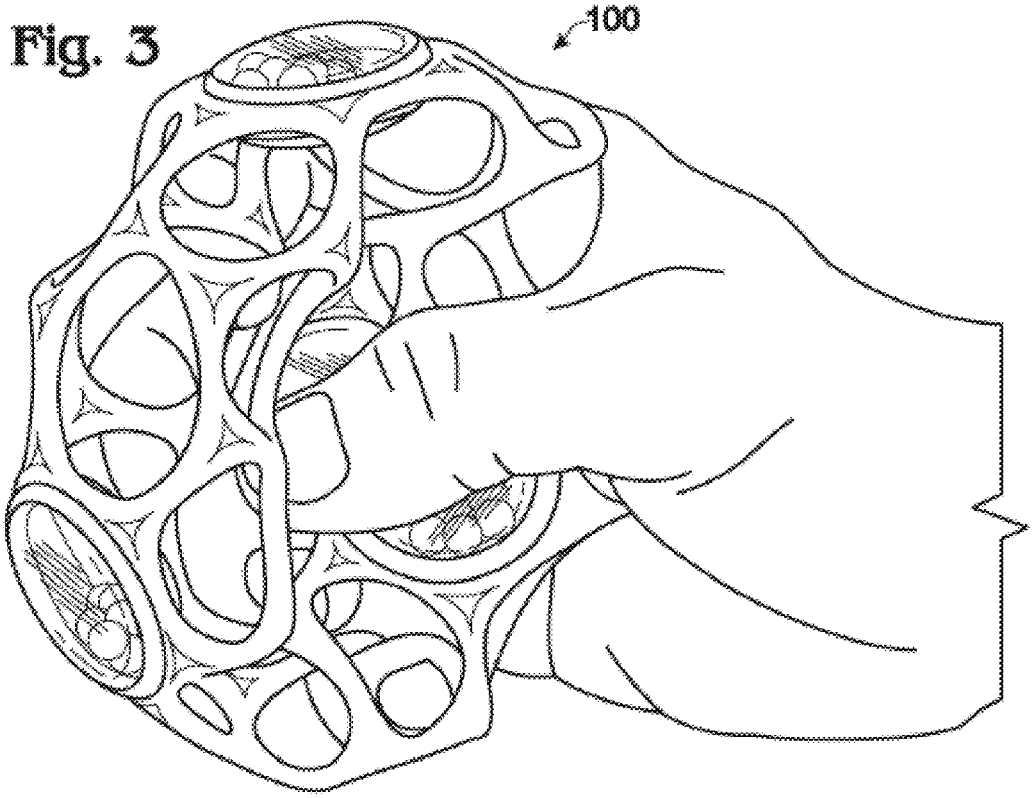
FIG. 3 is a perspective view of the toy apparatus of FIG. 1, temporarily crushed by the hand of a user.

In the embodiment illustrated in FIG. 1, the mesh 104 is formed as a resiliently deformable ball, which facilitates tossing, bouncing, catching and other forms of play. As illustrated in FIG. 3, the ball may be crushed by the hand of a user, such as a child, and typically springs back to its original size, which provides spring to the ball when hit or kicked, and promotes safe play.

As illustrated in FIG. 2, the body of the rattle is divided into two halves, a bottom half 124B and a top half 124A, each of which is domed outward, the top half and bottom half defining a central void 125. As viewed from above in FIG. 1, the outer perimeter 120 of mounting structure 118 is circular, and the inside perimeter surface 112 of the loop structure 106 of the mesh in which each rattle 122 is mounted, is circular. As viewed in cross section in FIG. 2, the outer perimeter 120 of mounting structure 118 has a concave radius formed in the edge thereof, to accommodate a round cross section of the loop structure 106. The top half 124A and bottom half 124B are typically joined to each other in an interior of the loop structure 106, being adhered to each other along a seam 119 in the vicinity of the mounting structure 118. Thus, as can be seen from FIG. 2, portions of the top half and bottom half form the mounting structure 118. In one embodiment, the mounting structure is plastically welded to the insider perimeter surface 112 of the loop structure of the mesh, although adhesives or other joining techniques may be used.

It will be appreciated that the body 116 of each rattle 122 may be substantially watertight, and may provide buoyancy to the apparatus 100, enabling it to float in water, which may be advantageous. Further, the domed shape construction of the top half 124A and bottom half 124B provide strength to the rattles 122. Further, since the domed shape is usually of a relatively low profile, the top half 124A does not extend outward from the surface 102 of the toy apparatus 100 to an extent that inhibits rolling of the toy apparatus in the embodiment of FIG. 1.

As can be seen in FIG. 1, the bottom half 124B and top half 124A of the rattle 122 are transparent or at least partially transparent, and objects such as balls 126 that are positioned within the void 114 can be seen through the transparent halves that form the body 116. A variety of materials may be used for the transparent halves of the body 116, such as acrylic or polycarbonate. In some embodiments, the balls 126 may be of various colors to provide visual contrast and enjoyment for users. Further, when shaken or otherwise disturbed, the balls 126 colliding with each other and the body 116 of the rattle 122 produce a noise that is pleasing.

Figure 4:
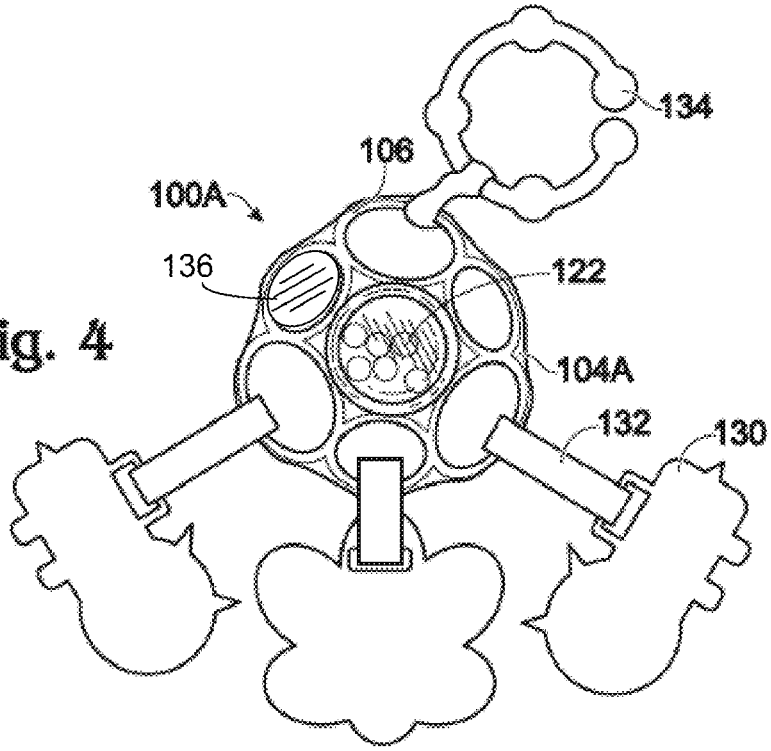
FIG. 4 illustrates a second embodiment of a toy apparatus according to the subject invention, in the form of a mesh of loop structures with a rattle assembly inserted into a loop structure of the mesh, the mesh being formed so as not to enclose a void.

As illustrated in FIG. 4, a second embodiment of a toy apparatus 100A is illustrated. Toy apparatus 100A includes a mesh 104A formed of loop structures 106 as described above. Mesh 104A forms a surface that does not enclose a void. One or more rattles 122 as described above may be provided in loop structures of the mesh 104A. Further, one or more accessories 130 may be connected with the mesh 104A. Each accessory 130 may be connected with a rim of a loop structure of the mesh by a fastener, for example, such as a short belt 132. A clip 134 may be used to attach the toy apparatus 100A to an object such as a high chair, car seat, stroller, etc., to prevent loss and give a child the ability to continue play in these environments. The accessories 130 may be in a wide variety shapes and sizes. For example, the accessories 130 may be in the form of teething rings, character shapes, etc., making the toy apparatus 100A suitable for use by small children and infants. The accessory 130 may also be in the form of a disc 136, on which indicia is provided, or to which a structure such as an ornament may be mounted.

Figure 5:
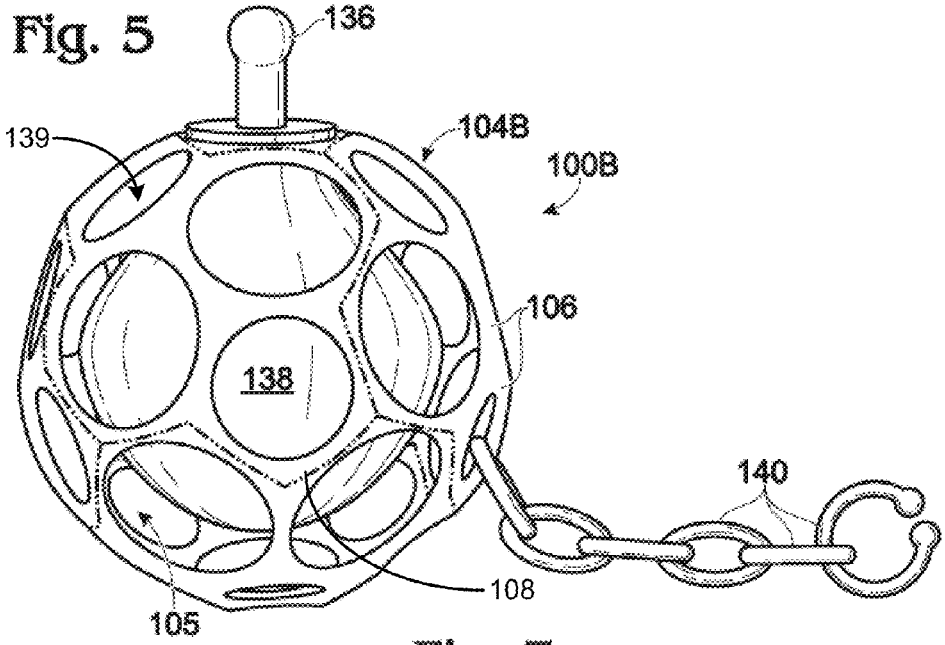
FIG. 5 is a perspective view illustrating a third embodiment of an apparatus according to the invention, in the form of a mesh with a manducable protrusion coupled thereto and a bladder formed therein.

In FIG. 5, a third embodiment of a toy apparatus 100B is illustrated. Toy apparatus 100B includes a mesh 104B formed of a plurality of closed loop structures 106, each defining an open space, as described above. A manducable protrusion 136 may be removably coupled to the mesh 104B at one of the loop structures. In the depicted embodiment the manducable protrusion is removably coupled to a container 138, which is removably attached to a loop structure. However, in other embodiments the manducable protrusion may be directly coupled to a loop structure.

While the depicted loop structures are circular, it will be appreciated that they may be of other shapes, such as oval, polygonal, etc. Thus, the mesh may include open spaces that are bounded by loops structures in the shape of ovals, polygons, etc. These alternative geometric configurations of the loop structures may be selected for ease of manufacturing and to meet consumer preferences, for example. As some examples, the mesh may be formed in the shape of a polyhedron, such as a truncated icosahedron, a dodecahedron, a tetrahedron, an icosahedron, or an icosadodecahedron.

An alternate way of describing the toy apparatus is as follows. Toy apparatus 100 may include a mesh structure 104B formed from a plurality of elongated strands 106. Mesh structure 104B may also include a joinder region 108 uniting adjacent strands to form a plurality of closed-perimeter openings 139. In particular the joinder regions may unite adjacent strands at a distance along the length of an outer perimeter of the elongated strands, and may be configured to couple together for a distance along their lengths. As previously discussed the closed-perimeter openings may be curved or alternatively may be in the shape of a polygon.

Figure 9:
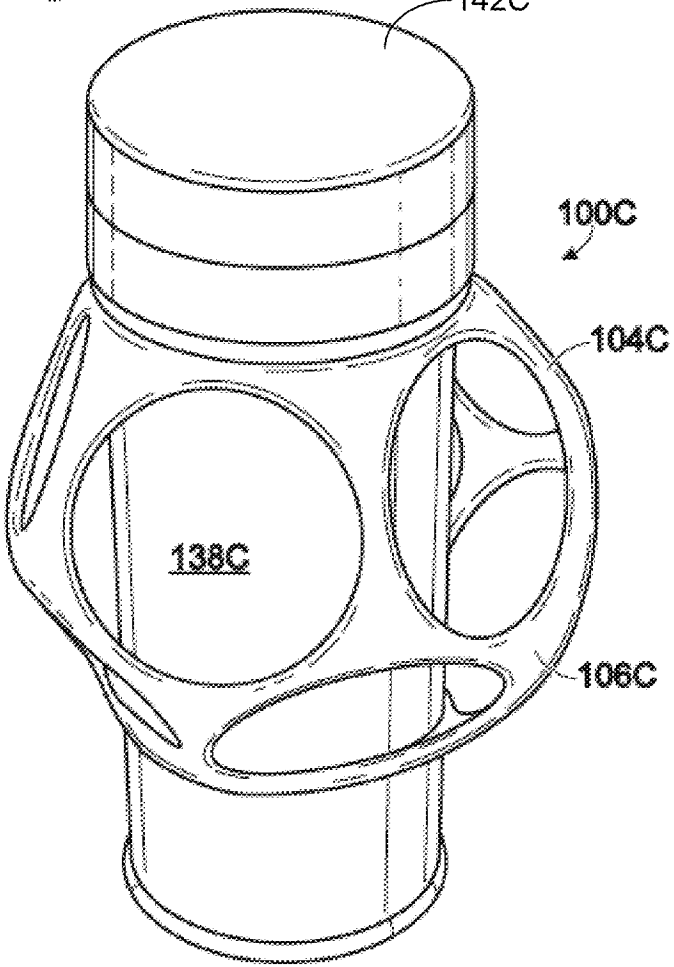
FIG. 9 is a perspective view illustrating the embodiment of FIG. 8, with a cap on the bottle.
Figure 8:
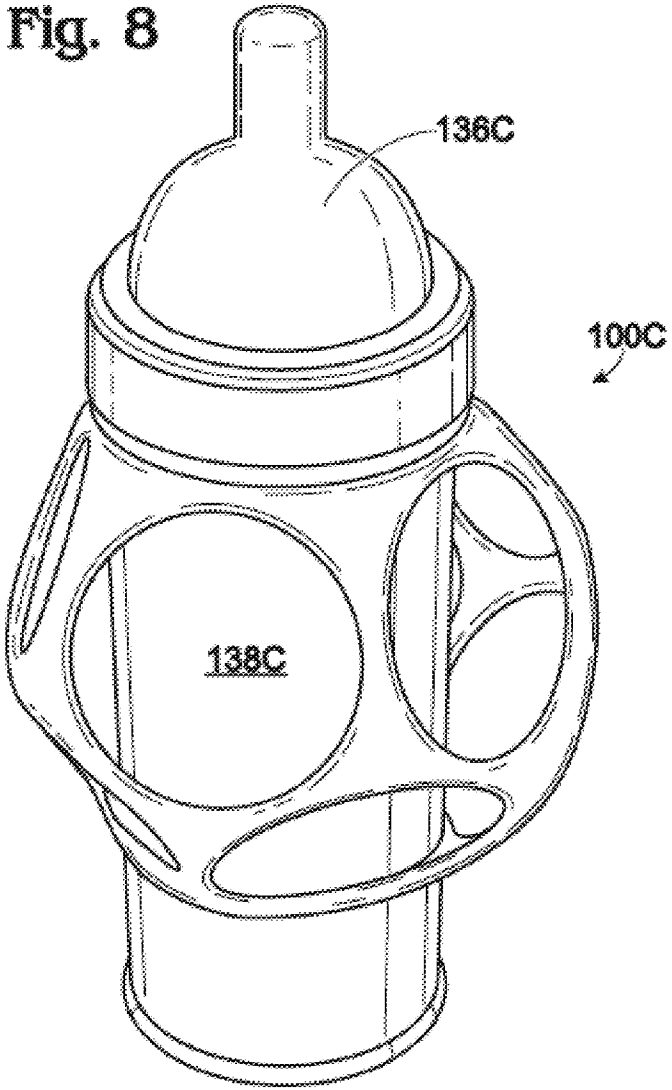
FIG. 8 is a perspective view illustrating a fourth embodiment of an apparatus according to the invention, in the form of a mesh with a bottle mounted therein.

Container 138 may store liquids such as milk, juice, water, etc. As depicted, the container may be positioned in the void 105 enclosed by the mesh. However, in alternate embodiments, as shown in FIGS. 8 and 9, the container may extend beyond the mesh through an opening in the loop structure, discussed in greater detail herein. In some embodiments, container 138 may be a bladder designed to expand and contract when filled and emptied. The bladder may be formed of a suitable material, such as a polymeric material. In other embodiments container 138 may be substantially rigid, and made of a material such glass, metal, or a substantially rigid polymer such as Polyethylene Terephthalate (PET). A cap 142 may be coupled to the container to prevent liquid from flowing out of the container when the manducable protrusion is not attached, or alternatively to cover the manducable protrusion when it is attached to keep it clean.

Returning to FIG. 5, it will be appreciated that in some examples the manducable protrusion may be formed out of a resiliently deformable polymeric material such as silicone, latex, etc. However, in other examples the manducable protrusion may be formed out of a harder material such as a polycarbonate. As illustrated the manducable protrusion is in the shape of a nipple, which contains a hole through which the liquid contents of the container may be extracted and consumed by an infant. However, it will be appreciated that the material, size, color, texture, etc., of the manducable protrusion may take other forms. Thus, in other exemplary embodiments, the manducable protrusion may be a pacifier or a teething accessory that an infant may chew on. By providing a manducable protrusion coupled to a mesh with loop structures in this manner, even young infants can securely grip the loops structures and mesh, to pull the manducable protrusion into and out of their mounts.

For convenience, a plurality of clips 140 may be coupled to the toy apparatus allowing the toy apparatus to be attached to an object such as a stroller, chair, car seat, etc.

Figure 7:
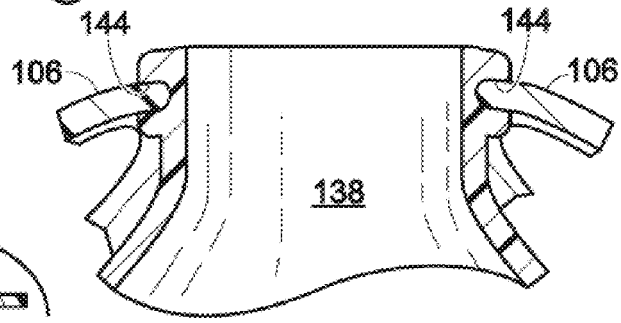
FIG. 7 is a partial detail cross-sectional view illustrating the coupling of a mesh structure to the bladder in the apparatus of FIG. 5.
Figure 6:
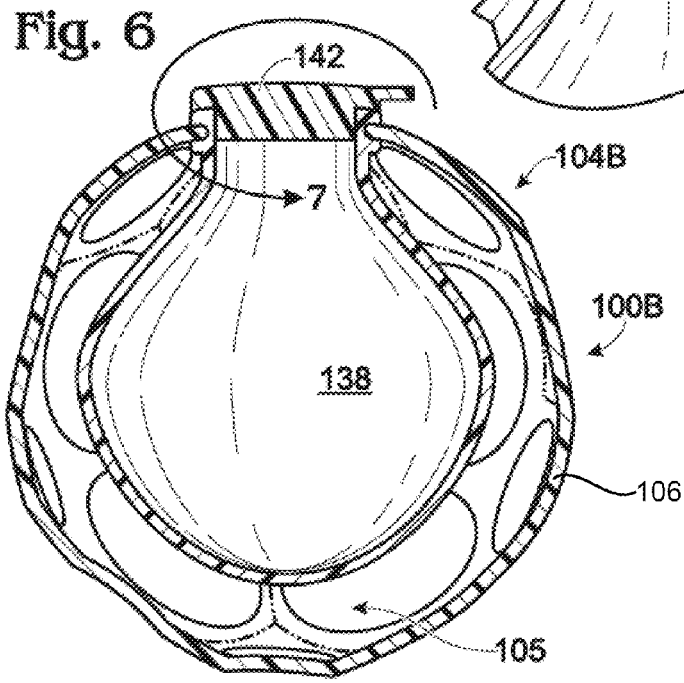
FIG. 6 is a cross-sectional view of the apparatus of FIG. 5.

As illustrated in FIG. 7 the container may include a mounting structure configured to removably attach to a loop structure. Specifically the mounting structure may have an outer perimeter edge 144 sized to conform to an inside perimeter of the loop structure. As previously discussed, the inside perimeter of the loop structure may be curved. Therefore, the mounting structure may have a concave radius formed in the edge thereof, to accommodate a round cross section of the loop structure. However, in other embodiments the inside perimeter of the loop structure may have flat surfaces and edges. Therefore, the mounting structure may have an outer perimeter edge sized to conform to the flat surfaces and edges. Furthermore, as previously discussed the loop structure may be a mesh structure in the form of a polygon, such as an octagon or a hexagon. Therefore, the mounting structure may be sized to conform to the shape of a polygon. The mounting structure may be formed in the shape of a disc, such as disc 136 of FIG. 4, of substantially uniform cross sectional thickness, or may have a cross sectional thickness that varies. Other accessories or ornaments may be mounted to an outer surface of the disc for example by use of adhesives or solvents.

FIGS. 8 and 9 illustrate a fourth embodiment of a toy apparatus 100C having a mesh 104C including a plurality of mesh structures 106C, each of which bounds an associated opening in the mesh. The mesh 104C is depicted as being in the shape of a dodecahedron, although the mesh may be in the form of other shapes, such as other polyhedrons, as discussed elsewhere herein. The toy apparatus may further include a manducable protrusion 136C and a container 138C as illustrated in FIG. 8. In the depicted embodiment, container 138C may extend through respective openings in loop structures positioned on opposite sides of the mesh 104C. In this way, the mesh may be secured to the container in spaced apart locations at opposed ends of the container, thereby ensuring a secure hold on the container by the mesh 104C, and in turn by an infant or toddler holding the mesh. As shown in FIGS. 8 and 9, the container includes a surface in face sharing contact with the curved perimeters of the two openings. Further, this design accommodates a larger container, and thus a greater amount of liquid may be stored within the container than within a container that is positioned entirely within the mesh. The manducable protrusion may be removed and a cap 142C may be attached to the container to prevent spills, as illustrated in FIG. 9. Alternatively, cap 142C may be sized to cover the manducable protrusion, for example, to keep it clean. While in the illustrated embodiment of FIGS. 8 and 9, the bottle is shown in a cylindrical form, it will be appreciated that other shapes and sizes may be used. Material choices for the bottle of FIGS. 8 and 9 include glass, plastic, or metal, for example.

The above described embodiments provide an apparatus that is easily graspable, even by the small hands of infants and toddlers, due to its mesh structures, and that provides sound and visual stimulation to users when shaken through its rattles mounted in the mesh structures. The above described embodiments further provide an apparatus that may be used for a teething, suckling, or masticating, thereby comforting an infant and assisting in the infant's development.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An apparatus, comprising:

a plurality of elongated strands having joinder regions uniting adjacent strands at a distance along a length of an outer perimeter of the elongated strands, the elongated strands being configured to couple together for a distance along their lengths, wherein the elongated strands form a surface of a mesh when the joinder regions are coupled and include a plurality of openings each having a curved perimeter including a convex cross section; and a manducable protrusion coupled to a container and extending a distance away from an exterior surface of the mesh, the container coupled to the mesh and extending through two openings a distance away from the exterior surface of the mesh, the container including a surface in face sharing contact with the curved perimeters of the two openings.

2. The apparatus of claim 1, wherein the manducable protrusion is formed in a shape of a nipple.

3. The apparatus of claim 1, wherein the mesh encloses a void, and the manducable protrusion extends a distance away from the exterior surface of the mesh, away from the void.

4. The apparatus of claim 1, wherein the mesh is in the shape of a polyhedron.

5. The apparatus of claim 4, wherein the mesh is in the shape of a truncated icosahedron, a dodecahedron, a tetrahedron, an icosahedron, or an icosadodecahedron.

6. The apparatus of claim 1, wherein the container is a bottle.

7. The apparatus of claim 1, wherein the container is removably coupled to elongated strands of the mesh at each of two opposite sides of the mesh, so as to extend through respective open spaces defined by the elongated strands on each of the two opposite sides of the mesh.

8. An apparatus comprising:

a mesh including a plurality of mesh structures each bounding an opening having a curved perimeter including a convex cross section, the mesh structures having cooperative mating surfaces disposed at least partially around an outer perimeter of each mesh structure, wherein the cooperative mating surfaces of adjacent mesh structures are configured to couple together for a distance along their lengths, wherein the mesh structures form a surface of the apparatus when the cooperative mating surfaces are coupled with each other; and a manducable protrusion coupled to a container and extending at a distance from an exterior surface of the mesh and away from a void enclosed by the mesh, the container coupled to the mesh and extending through two openings a distance away from the exterior surface of the mesh, the container including a surface in face sharing contact with the curved perimeters of the two openings.

9. The apparatus of claim 8, wherein the manducable protrusion is formed of a deformably resilient material.

10. The apparatus of claim 8, wherein the manducable protrusion is removably coupled to the mesh structure.

11. An apparatus comprising:

a mesh including a plurality of mesh structures each bounding an opening having a curved perimeter including a convex cross section, the mesh structures having cooperative mating surfaces disposed at least partially around an outer perimeter of each mesh structure, wherein the cooperative mating surfaces of adjacent mesh structures are configured to couple together for a distance along their lengths, wherein the mesh structures form a surface of the apparatus when the cooperative mating surfaces are coupled with each other, and wherein the surface of the mesh is formed in the shape of a polyhedron; and a manducable protrusion coupled to a container, the container coupled to at least one mesh structure, the manducable protrusion extending outwardly at a distance from an exterior surface of the mesh and away from a void enclosed by the mesh, wherein the manducable protrusion is formed in the shape of a nipple, the container coupled to the mesh and extending through two openings a distance away from the exterior surface of the mesh, the container including a surface in face sharing contact with the curved perimeters of the two openings.

12. The apparatus of claim 11, wherein the container is a bottle.

* * * * *